United States Patent [19]

Thorn

[11] 4,191,524

[45] Mar. 4, 1980

[54] FUEL OIL SUPPLY SYSTEM HAVING AN ELECTRICALLY HEATED FILTER

[76] Inventor: Michael R. Thorn, 107 E. Sherman St., Lynn, Ind. 47355

[21] Appl. No.: 834,116

[22] Filed: Sep. 19, 1977

[51] Int. Cl.[2] ..... F24D 11/44; B01D 35/18; F24H 1/12

[52] U.S. Cl. ..... 431/208; 137/341; 210/186; 219/205; 219/296; 219/521; 219/552; 222/146 HE; 239/135

[58] Field of Search ..... 219/205–208, 219/202, 200, 201, 296, 297, 301, 311, 310, 280–283, 520–522, 535, 552, 214, 415–419; 210/184–186; 222/146 R, 146 HE, 146 H; 431/207–209, 202, 232, 240, 242, 11, 36, 41, 203; 137/341, 59, 297, 301; 239/128, 134, 135; 184/104 R, 104 A; 123/142.5, 142.5 E

[56] References Cited

U.S. PATENT DOCUMENTS

| | | | |
|---|---|---|---|
| 1,604,979 | 11/1926 | Dominguez | 219/332 X |
| 1,620,537 | 3/1927 | Garey | 219/521 X |
| 2,064,511 | 12/1936 | Wells | 210/186 |
| 2,111,056 | 3/1938 | Sickinger | 219/415 |
| 2,166,912 | 7/1939 | Little | 431/36 |
| 2,177,101 | 10/1939 | Franzwa | 219/552 X |
| 2,250,903 | 7/1941 | Browning | 431/41 |
| 2,292,992 | 8/1942 | Crouch | 219/521 |
| 2,348,247 | 5/1944 | Dushane | 210/186 |
| 2,355,693 | 8/1944 | Aldrich | 210/184 X |
| 2,397,142 | 3/1946 | Howard | 431/11 |
| 2,429,321 | 10/1947 | La Brecque | 210/186 |
| 2,593,459 | 4/1952 | Johnson | 210/535 X |
| 2,745,552 | 5/1956 | Bruggeman et al. | 210/186 X |
| 2,955,191 | 10/1960 | Galgano et al. | 219/214 UX |

FOREIGN PATENT DOCUMENTS

| | | | |
|---|---|---|---|
| 487397 | 11/1953 | Italy | 219/521 |
| 894815 | 4/1962 | United Kingdom | 219/535 |
| 1044001 | 9/1966 | United Kingdom | 219/296 |

*Primary Examiner*—A. Bartis

*Attorney, Agent, or Firm*—Biebel, French & Nauman

[57] ABSTRACT

A fuel oil supply system for providing fuel oil to a heater in a building includes a storage tank, a gravity feed supply line running from the fuel oil tank to the building, a fuel oil heater in the building receiving the fuel oil from the supply line, and a canister filter connected in the supply line. A means for heating the canister filter includes a heater enclosure defining a filter cavity which is sized to receive the canister filter. The heater enclosure includes a substantial cylindrical lower portion and a substantial cylindrical cap portion which interfit to enclose the filter. The cap portion defines openings for passage of the supply line therethrough and the lower portion and the cap portion are joined by set screws. An electrical heater in the filter cavity comprising a light bulb positioned below the bottom of the filter provides a source of heat to the canister filter. Power is supplied to the light bulb by a power cord including a thermostat. The bottom of the filter cavity in the heater enclosure slopes downward away from the light bulb toward the periphery of the lower portion of the enclosure, around which are defined a plurality of weep holes which permit the removal of condensation.

4 Claims, 4 Drawing Figures

FUEL OIL SUPPLY SYSTEM HAVING AN ELECTRICALLY HEATED FILTER

BACKGROUND OF THE INVENTION

The present invention relates to fuel oil heaters and, more particularly, to an electrical heater for improving the operation of a canister filter in the supply line for a fuel oil heater.

A large number of homes in the United States are presently heated by fuel oil systems. Such a system will typically include a storage tank for storing a large quantity of fuel oil which will be consumed by the system over a period of time, depending upon the severity of the weather. Although some storage tanks for home fuel oil heating systems are buried underground, it is common to provide an elevated storage tank above ground. With such an arrangement, no pump will be needed for supplying the fuel oil to the home; rather, the supply line from the tank into the home can be a gravity feed line. Such a line will often include a canister filter to remove particulate matter which may be suspended in the fuel oil.

Although fuel oil filters of this type generally operate effectively, severely cold weather will cause the fuel oil to become much more viscous. When this occurs, the oil in the supply line will not flow through the filter as easily as under normal operating conditions and the fuel oil may tend to thicken and congeal in the filter. A point may be reached in which the fuel oil supply to the home will be reduced below the level of that needed for operation of the fuel oil furnace. The flow of fuel oil through the filter may in fact stop completely if the temperature of the oil is reduced sufficiently.

In the past, it has been known to provide heat to fuel supply filters for various reasons. In U.S. Pat. No. 2,166,912, issued July 18, 1939, to Little, a fuel supply system for storing and supplying hydrocarbon gas, such as butane or propane, is provided with a gasifying unit which is connected to a buried supply tank. The gasifying unit heats the fuel as it is bubbled through a water compartment which cleanses it of tar and other foreign matter. The heater unit has a gas jet burner beneath the water compartment providing a source of heat.

In U.S. Pat. No. 2,397,142, issued Mar. 26, 1946, to Howard, a filter is disclosed having a series of burners positioned therebeneath which heat a fuel, such as gasoline, as the fuel is filtered. The fuel is filtered to remove lead particles from the gasoline and the heating causes such particles to precipitate out of the liquid fuel.

U.S. Pat. No. 2,250,903, issued July 29, 1941, to Browning, shows as in-ground butane supply tank in which a heating pipe passes a heated fluid through the tank to heat the butane stored in the tank.

A need exists, however, for a heating arrangement particularly configured to provide effective and efficient heat to a canister filter in a fuel oil heating system supply line to prevent the fuel oil passing therethrough from coagulating and retarding the flow of fuel to the system. Such a heating arrangement shold be simple, reliable, and provide an efficient source of heat to the filter. Additionally, it is desirable for such a heating arrangement to be relatively inexpensive to manufacture and to require little maintenance.

SUMMARY OF THE INVENTION

A heater for heating a canister filter in a fuel oil supply line in which the filter is substantially cylindrical with the supply line extending radially therefrom, includes a heater enclosure. The enclosure has a lower portion and an interfitting cap portion and defines a filter cavity for receiving the canister filter. The lower portion of the enclosure is sized to surround the canister filter beneath the supply line and the cap portion is sized to surround the top of the canister filter and to extend below the supply line such that it overlaps the upper edge of the lower portion. The cap portion further includes means defining slots of a width greater than the diameter of the supply line. A means is provided for joining the lower portion and the cap portion of the heater enclosure. An electrical heater means in the enclosure may include a light bulb which heats the filter cavity. Means are provided for supplying electrical power to the heater means.

The means for joining the lower portion and the cap portion of the enclosure may include set screws which extend through threaded openings in the cap portion and engage the lower portion. At least one weep hole is defined by the lower portion of the enclosure such that condensation collecting in the filter cavity will be removed therefrom. The means for supplying electrical power includes an electrical thermostatic means for connecting power to the electrical heater means when the ambient temperature drops below a predetermined temperature level. The heater enclosure may advantageously be formed from a plastic material.

Accordingly, it is an object of the present invention to provide a heater device for a canister filter in a fuel oil supply line in which the source of heating is an easily replaceable electrical heating element, such as a light bulb; to provide such a heater in which the heater enclosure is particularly sized and adapted to surround a fuel oil canister filter; to provide such a heater which is simple in construction and which effectively prevents coagulation of the fuel oil passing through the filter.

Other objects and advantages of the invention will be apparent from the following description, the accompanying drawings and the appended claims.

DETAILED DESCRIPTION OF THE PREFERRED EMBODIMENT

Figure 1:
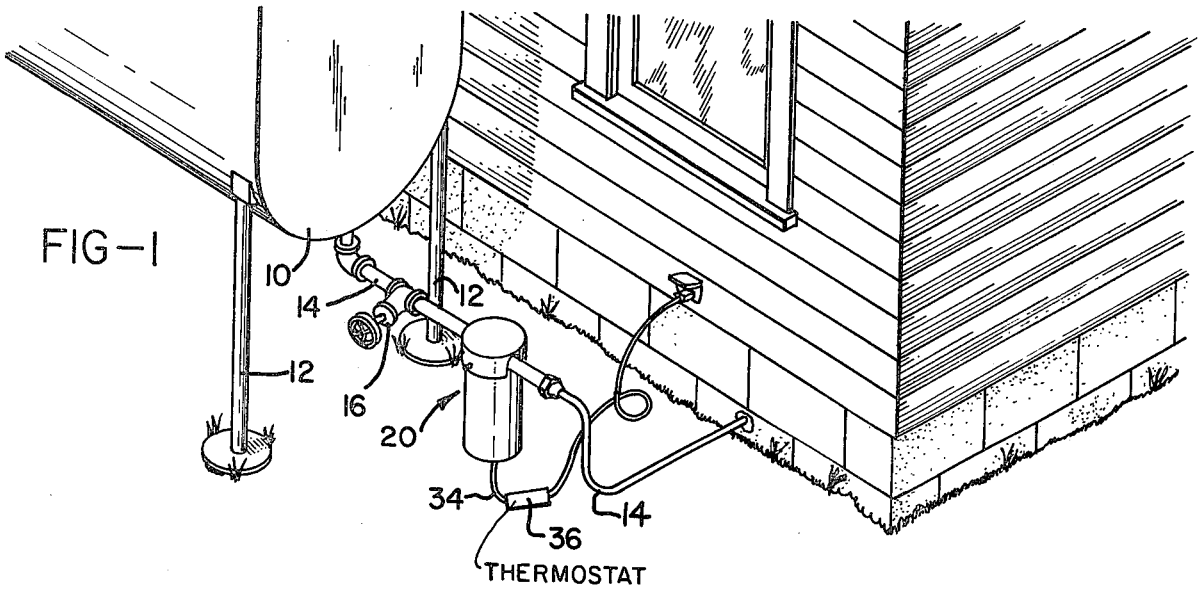
FIG. 1 is a perspective view of a portion of a fuel oil heating system, showing the fuel storage tank and supply arrangement.

Reference is now made to FIG. 1 in which a fuel oil supply system incorporating the present invention is illustrated. A storage tank 10 is mounted on supports 12 outside the building which is to be heated. Tank 10 may typically provide for storage of a substantial quantity of fuel oil and will be refilled from time to time. A gravity feed supply line 14 runs from the storage tank 10 into the building and is connected to the fuel oil heater or furnace in the building. A manually operable valve 16 may be provided in line 14 to enable the supply line to be closed during servicing.

Figure 2:
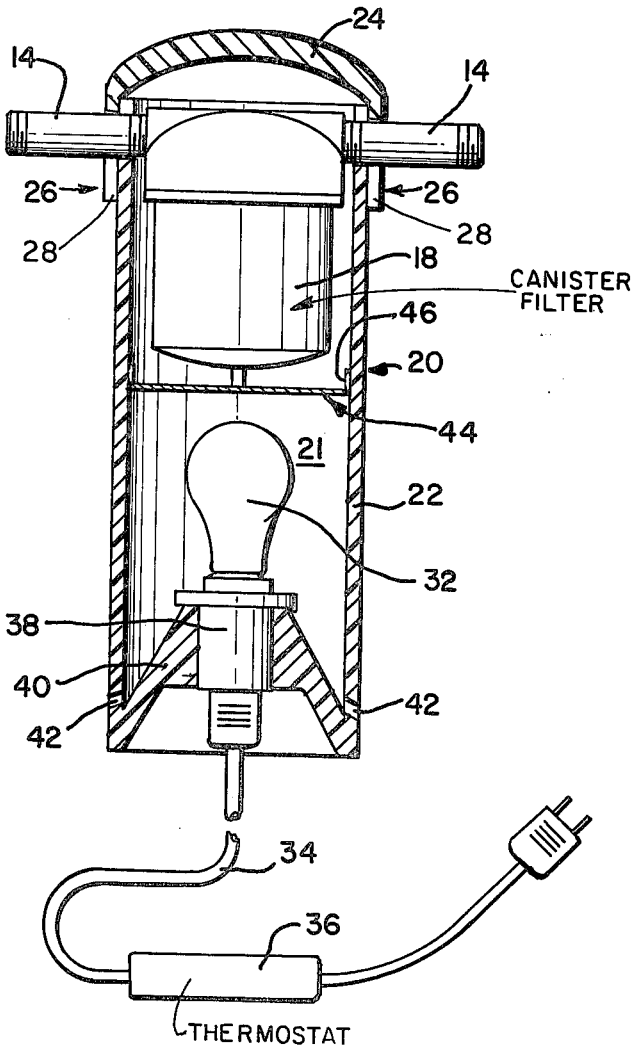
FIG. 2 is a sectional view taken generally axially with respect to the heater of the present invention, revealing the internal structure and the enclosed canister filter.
Figure 3:
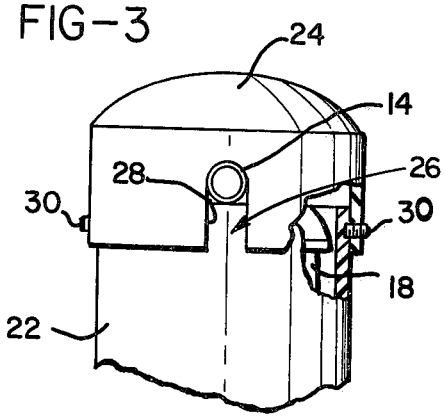
FIG. 3 is a partial view of the heater of the present invention with portions broken away and in section to reveal internal structure.

A canister filter 18 is connected in supply line 14 for filtering fuel oil flowing therethrough, as illustrated in FIG. 2. A means for heating the filter includes a heater enclosure 20 defining a filter cavity 21 which is sized to receive the canister filter 18. The enclosure 20 includes a substantially cylindrical lower portion 22 and a substantially cylindrical cap portion 24. The lower portion 22 and the cap portion 24 interfit to enclose the filter 18 in filter cavity 21. The cap portion 24 defines openings 26 for passage of the supply line 14 therethrough to the filter 18. As seen in FIG. 3, these openings in the cap portion 24 are defined by slots 28. The lower portion 22 and the cap portion 24 of enclosure 20 may typically be formed of a plastic material and may advantageously be manufactured by injection molding techniques.

As seen in FIG. 3, the heater enclosure further includes means for joining the lower portion 22 and the cap portion 24, such as set screws 30. Set screws 30 may pass through threaded openings in the cap portion 24 and engage the lower portion 22 of the enclosure 20.

An electrical heater means includes a light bulb 32 which is mounted in cavity 21 in the heater enclosure 20 and which provides a source of heat for the canister filter 18. The means for supplying electrical power to the light bulb includes an electrical power cord 34 and a thermostat 36 of conventional design which supplies power to the light bulb when the ambient temperature is less than a predetermined temperature level. As seen in FIG. 1, the cord 34 will typically be connected to an outside electrical outlet and the thermostat 36 will thus be exposed to the outside temperature.

The light bulb 32 is mounted in a conventional socket arrangement 38 which forms part of a means for mounting a light bulb in a cavity. The socket 38 is held in the bottom 40 of the heater enclosure which acts as a means for mounting the bulb in the cavity 21 such that the bottom of the filter cavity 21 slopes downward, away from the bulb 32 toward the periphery of the lower portion 22. A plurality of weep holes 42 are defined in the periphery of the lower portion 22 of the enclosure 20 to permit condensation to be removed from the cavity 21. The bulb socket 38 may be glued or otherwise potted into place in the bottom 40 of the lower portion 22.

Figure 4:
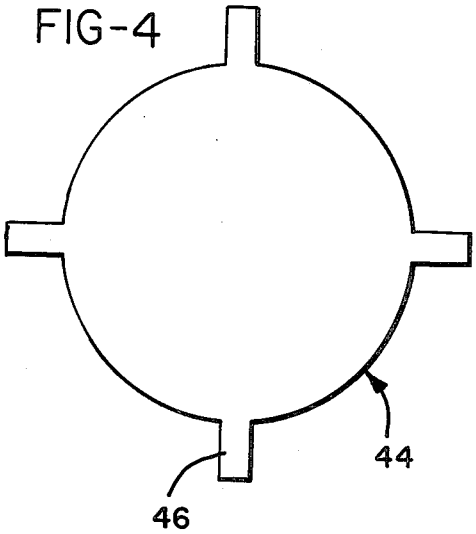
FIG. 4 is a view of a drip shield which may be used in the present invention.

As seen in FIGS. 2 and 4, a drip shield 44 may be positioned in cavity 21 above the bulb 32. The shield may typically be formed from a sheet of thin tin or other suitable material and will include a plurality of tabs 46 positioned around its periphery. When the shield 44 is inserted into cavity 21, tabs 46 will be bent as shown and will provide a spring force which will hold the shield at the desired position in the cavity. Shield 44 is provided to prevent condensation from dripping directly onto the incandescent bulb 32. Toward this end, the diameter of the shield need not be as great as the interior diameter of the cavity 21 as long as sufficient shielding is provided. Since the shield 44 is formed of a conductive material, the heating provided by the bulb 32 will be substantially unaffected.

The canister filter 18 and the fuel oil therein are heated by the present invention and the viscosity of the fuel oil is maintained at a sufficiently low level to insure adequate flow of fuel oil through the filter. This permits the fuel oil furnace in the building to operate satisfactorily, even during periods of extremely cold weather. It will be appreciated that the use of a light bulb in the bottom of the heater enclosure as a source of heat has several advantages. The light bulb can be easily replaced when it eventually burns out and such replacement may be made at a minimal cost. Additionally, bulbs of varying size may be used in the heater device depending upon the climatic conditions experienced. Colder weather may require the use of higher wattage bulbs.

The following is a table of temperatures maintained by the heating device of the present invention, showing the effect of using bulbs of various sizes. These temperature readings were taken with an ambient temperature of 80° F.

| BULB SIZE (WATTS) | VOLTAGE | TEMPERATURE (°F.) |
|---|---|---|
| 100 | 115 | 287 |
| 60 | 115 | 237 |
| 75 | 115 | 235 |
| 50 | 230 | 138 |
| 40 | 115 | 178 |
| 15 | 130 | 129 |

It will be seen, therefore, that it may be advantageous to replace a relatively small bulb with a larger bulb as winter weather becomes more severe in order to insure adequate heating of the fuel oil filter in the supply line.

While the form of apparatus herein described constitutes a preferred embodiment of the present invention, it is to be understood that the invention is not limited to this precise form of apparatus and that changes may be made therein without departing from the scope of the invention.

What is claimed is:

1. In a fuel oil supply system for a fuel oil heater in a building including a storage tank for storing fuel oil located outside the building, a feed supply line running from said fuel oil tank to said building, a fuel oil heater in said building receiving fuel oil from said supply line, and a canister filter connected in said supply line for filtering fuel oil flowing therethrough, the improvement in said supply system comprising a means for heating said filter, including:

a heater enclosure defining a filter cavity sized to receive said canister filter and including a substantially cylindrical lower portion having a closed bottom and a substantially cylindrical cap portion, said lower portion and said cap portion interfitting to substantially completely enclose said filter in said filter cavity, said cap portion defining openings for passage of said supply line therethrough to and from said filter, said lower portion defining a plurality of weep holes around its periphery near the bottom thereof, said heater enclosure further including means for joining said lower portion and said cap portion, electrical heater means comprising a light bulb mounted in said filter cavity in said heater enclosure for providing a source of heat to said canister filter, said heater means further including means mounting said light bulb on the bottom of said lower portion below the canister filter, the bottom of said lower portion being sloped downwardly away from said light bulb toward the periphery of said lower portion whereby any condensate dropping on said bottom drains out through said weep holes, and means for supplying electrical power to said light bulb whereby said canister filter and the fuel oil therein are heated and the viscosity of said fuel oil maintained at a sufficiently low level to insure adequate flow through said filter to said heater in said building.

2. The fuel supply system of claim 1 in which said means for supplying power to said light bulb comprises an electrical power cord including an electrical thermostat, such that power is supplied to said light bulb when the ambient temperature sensed by said thermostat is less than a predetermined temperature level.

3. The fuel supply system of claim 1 in which said openings in said cap portion for passage of said supply line therethrough to and from said filter comprise open-bottom slots in said cap portion.

4. The supply of claim 3 in which said enclosure is formed of plastic and in which said means for joining said lower portion and said cap portion of said enclosure include set screws passing through threaded openings in said cap portion and engaging said lower portion.

* * * * *